US009657923B2

(12) United States Patent
Kwak et al.

(10) Patent No.: US 9,657,923 B2
(45) Date of Patent: May 23, 2017

(54) LIGHT EMITTING MODULE

(71) Applicant: LG ELECTRONICS INC., Seoul (KR)

(72) Inventors: Jinsung Kwak, Seoul (KR); Yongjin Kim, Seoul (KR); Seoyoung Jeong, Seoul (KR); Junhyung Kim, Seoul (KR); Hongseok Kim, Seoul (KR)

(73) Assignee: LG Electronics Inc., Seoul (KR)

( * ) Notice: Subject to any disclaimer, the term of this patent is extended or adjusted under 35 U.S.C. 154(b) by 169 days.

(21) Appl. No.: 14/552,058

(22) Filed: Nov. 24, 2014

(65) Prior Publication Data

US 2015/0146431 A1 May 28, 2015

(30) Foreign Application Priority Data

Nov. 25, 2013 (KR) ..... 10-2013-0144031
Oct. 28, 2014 (KR) ..... 10-2014-0147709

(51) Int. Cl.

| | |
|---|---|
| ***F21V 17/10*** | (2006.01) |
| ***F21V 29/83*** | (2015.01) |
| *F21V 5/00* | (2015.01) |
| *F21V 29/77* | (2015.01) |
| *F21Y 101/00* | (2016.01) |
| *F21Y 115/10* | (2016.01) |

(52) U.S. Cl.

CPC ..... *F21V 17/104* (2013.01); *F21V 29/83* (2015.01); *F21V 5/007* (2013.01); *F21V 29/773* (2015.01); *F21Y 2101/00* (2013.01); *F21Y 2115/10* (2016.08)

(58) Field of Classification Search

CPC ..... F21V 17/104; F21V 29/83; F21V 29/773; F21V 5/007; F21Y 2101/02

See application file for complete search history.

(56) References Cited

U.S. PATENT DOCUMENTS

2012/0092873 A1* 4/2012 Chang ..... F21V 31/005 362/294
2012/0218760 A1* 8/2012 Nagaoka ..... F21K 9/30 362/249.02

FOREIGN PATENT DOCUMENTS

KR 10-2010-0034262 A 4/2010
KR 10-2011-0060476 A 6/2011
KR 10-1310365 B1 9/2013
KR 101310365 B * 9/2013 ..... F21V 29/00

(Continued)

OTHER PUBLICATIONS

English Translation of KR101310365B, Sep. 2013, Kim et al.*

*Primary Examiner* — Mary Ellen Bowman

(74) *Attorney, Agent, or Firm* — Birch, Stewart, Kolasch & Birch, LLP

(57) ABSTRACT

A light emitting module includes a module body, a light source unit disposed at one side of the module body, an air hole formed through the module body from one side of the module body to the other side of the module body for allowing air to flow therethrough, and an optical cover for covering the light source unit. The optical cover has a cover hole at a location corresponding to the air hole. The optical cover includes a partition wall protruding downward from a bottom of the optical cover such that the partition wall is inserted into one side of the module body to seal the light source unit, and a pair of fitting wings protruding outward from opposite ends of the optical cover such that the fitting wings are inserted into the module body.

20 Claims, 14 Drawing Sheets

(56) References Cited

FOREIGN PATENT DOCUMENTS

| | | | |
|---|---|---|---|
| KR | 10-1412958 | B1 | 6/2014 |
| KR | 10-1446891 | B1 | 10/2014 |

* cited by examiner

LIGHT EMITTING MODULE

CROSS-REFERENCE TO RELATED APPLICATION

This application claims the priority benefit of Korean Patent Application No. 10-2014-0147709, filed on Oct. 28, 2014, and No. 10-2013-0144031, filed on Nov. 25, 2013, in the Korean Intellectual Property Office, the disclosure of each of which is incorporated herein by reference.

BACKGROUND OF THE INVENTION

1. Field of the Invention

The present invention relates to a light emitting module and a lighting device including the same.

2. Description of the Related Art

In general, incandescent bulbs or fluorescent lamps are usually used as indoor or outdoor lighting devices. However, a lifespan of the incandescent bulbs or the fluorescent lamps is short with the result that it is necessary to frequently replace the incandescent bulbs or the fluorescent lamps with new ones. In addition, conventional fluorescent lamps are deteriorated over time with the result that luminous intensity of the fluorescent lamps is gradually reduced.

In order to solve the above problems, there have been developed a variety of lighting modules adopting a light emitting diode (LED) which exhibits excellent controllability, rapid response speed, high electric light conversion efficiency, long lifespan, low power consumption, high luminance, and emotional lighting.

The LED is a kind of semiconductor device that coverts electric energy into light. The LED has advantages of low power consumption, semi-permanent lifespan, rapid response speed, safety, and environmental friendly properties as compared with conventional light sources such as fluorescent lamps and incandescent bulbs. For these reasons, much research has been conducted to replace the conventional light sources with the LED. Furthermore, the LED has been increasingly used as light sources of lighting devices, such as various liquid crystal displays, electric bulletin boards, and streetlights, which are used indoors and outdoors.

The light emitting device is manufactured in the form of a light emitting module for improving assembly convenience and protecting the light emitting device from external impact and moisture.

However, a plurality of light emitting devices is integrated with high density in the light emitting module with the result that heat is generated from the light emitting module. For this reason, research has been conducted to effectively dissipate heat from the light emitting module.

In addition, a lighting device using an optical semiconductor as a light source has been recently used for indoor and outdoor landscape lighting or security. For this reason, it is necessary to easily and conveniently assemble and install products. Furthermore, the products are used while being exposed to the atmosphere. For this reason, it is necessary to keep waterproofness of the products.

Therefore, there is a high necessity for device that is easily and conveniently inspected and repaired, is easily and simply disassembled and assembled, and exhibits high waterproofness and durability.

SUMMARY OF THE INVENTION

It is an object of the present invention to provide a light emitting module that is capable of effectively dissipating heat generated from a light emitting device, is easily fastened, and exhibits excellent waterproof performance and a lighting device including the same.

In accordance with an aspect of the present invention, the above and other objects can be accomplished by the provision of a light emitting module including a module body, a light source unit disposed at one major surface of the module body, an air hole formed through the module body from one major surface of the module body to the other major surface of the module body for allowing air to flow therethrough, and an optical cover for covering the light source unit, the optical cover having a cover hole corresponding to the air hole, wherein the optical cover includes a partition wall protruding downward from a bottom of the optical cover such that the partition wall is inserted into one major surface of the module body to seal light source unit and a pair of fitting wings protruding outward from opposite sides of the optical cover such that the fitting wings are inserted into the module body.

The module body may include insertion grooves, into which the respective fitting wings are inserted.

The module body may further include protruding ends protruding upward from opposite ends of one major surface of the module body, and side surfaces of the protruding ends may be depressed outward to form the insertion grooves.

The optical cover may be pushed downward due to elastic restoring force of the fitting wings.

The module body may further include a cover location groove for receiving at least the bottom surface and a portion of a side surface of the optical cover, and an inner side surface of the cover location groove may be depressed outward to form the insertion grooves.

The insertion grooves may be formed at opposite portions of the inner side surface of the cover location groove.

The optical cover may include a lens for changing a beam angle of light and an optical plate at which the lens is disposed, and a top surface of an edge of the module body and a top surface of the optical plate may be positioned on the same plane.

The fitting wings may be positioned at opposite ends of the optical plate in a longitudinal direction of the optical plate, and each of the fitting wings may have a smaller thickness than the optical plate.

The light emitting module may further include an air guide unit formed at an edge of the air hole in a state in which the air guide unit extends outward from the other major surface of the module body such that the air guide unit communicates with the air hole to guide air.

The partition wall may include an inner partition wall formed along a circumference of the cover hole, and the inner partition wall may be inserted into one major surface of the module body at the circumference of the air hole.

The module body may be provided at one major surface thereof with an inner coupling groove corresponding to the inner partition wall such that the inner partition wall is inserted into the inner coupling groove.

The module body may include a first inner protrusion protruding upward from one major surface of the module body and a second inner protrusion defining the inner coupling groove together with the first inner protrusion.

The first inner protrusion may be more adjacent to the air hole than the second inner protrusion, and an inner side surface of the first inner protrusion may be positioned on the same plane as an inner side surface of the air hole.

The light source unit may include a board located at one major surface of the module body, the board having a board hole corresponding to the air hole, and a plurality of light emitting devices disposed on the board, and the second inner protrusion may be fitted in the board hole.

The partition wall may further include an outer partition wall formed at an edge of the optical cover such that the outer partition wall extends along a circumference of the optical cover, and the outer partition wall may define a closed space, in which the light source unit is disposed, the outer partition wall being inserted into one major surface of the module body.

The module body may be further provided at one major surface thereof with a light source location groove, the light source location groove being depressed downward such that at least the board is located in the light source location groove, and the outer partition wall may be fitted in the light source location groove together with the board.

The outer partition wall may include a first outer partition wall contacting an outer surface of the board, a second outer partition wall spaced apart from the first outer partition wall such that the second outer partition wall surrounds the first outer partition wall, and a cover groove defined between the first outer partition wall and the second outer partition wall.

The module body may be further provided at one major surface thereof with an outer protrusion corresponding to the cover groove such that the outer protrusion is inserted into the cover groove, and a space, into which the first outer partition wall is inserted, may be defined between the outer protrusion and an outer side surface of the board.

The partition wall may include an outer partition wall formed at an edge of the optical cover such that the outer partition wall extends along a circumference of the optical cover, and the outer partition wall may define a closed space, in which the light source unit is disposed, the outer partition wall being inserted into one major surface of the module body.

The air guide unit may be thermally connected to at least some of the heat dissipation fins.

BRIEF DESCRIPTION OF THE DRAWINGS

The above and other objects, features and other advantages of the present invention will be more clearly understood from the following detailed description taken in conjunction with the accompanying drawings, in which.

DETAILED DESCRIPTION OF THE PREFERRED EMBODIMENTS

Reference will now be made in detail to the preferred embodiments of the present invention, examples of which are illustrated in the accompanying drawings.

Figure 1:
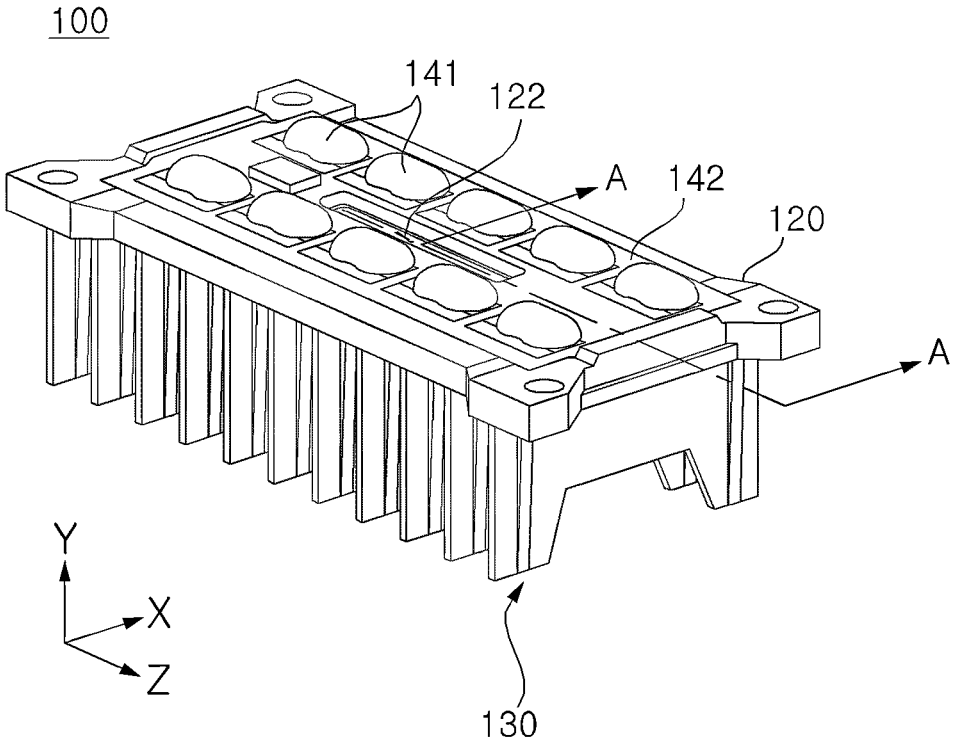
FIG. 1 is a perspective view showing a light emitting module according to an embodiment of the present invention.
Figure 2:
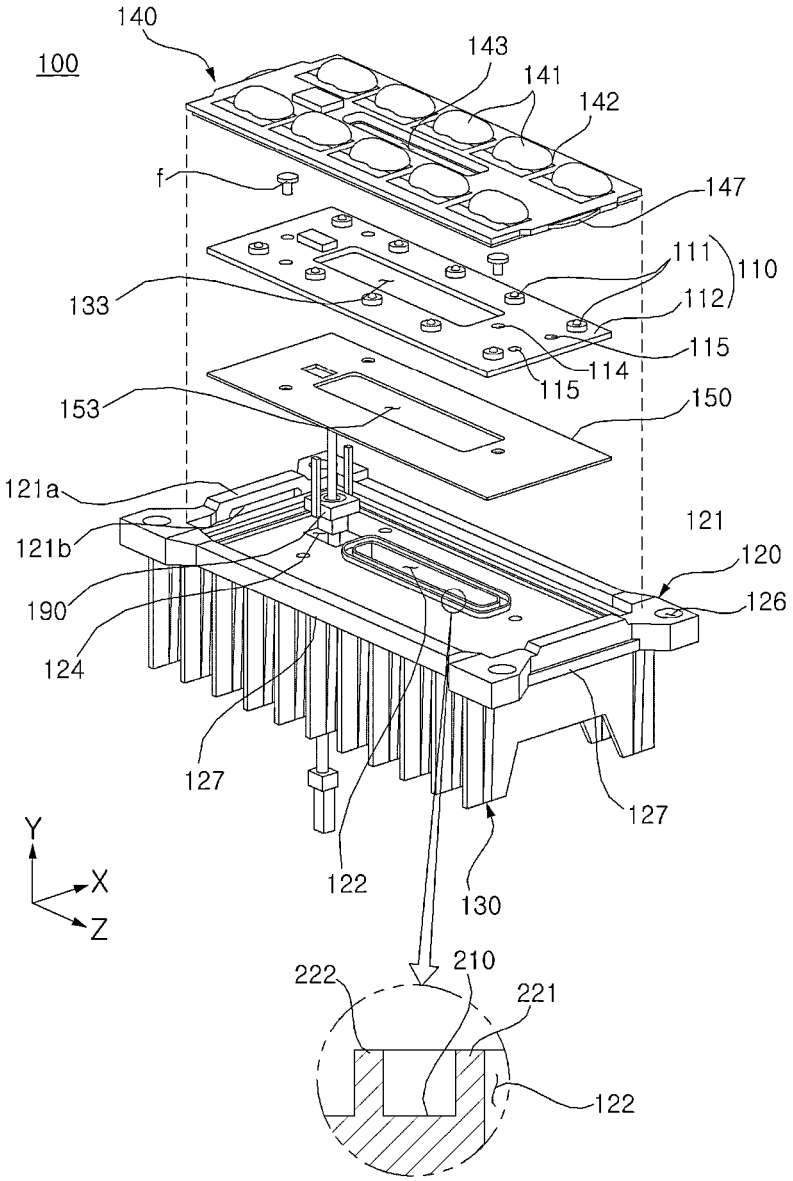
FIG. 2 is an exploded perspective view of the light emitting module shown in FIG. 1.
Figure 3:
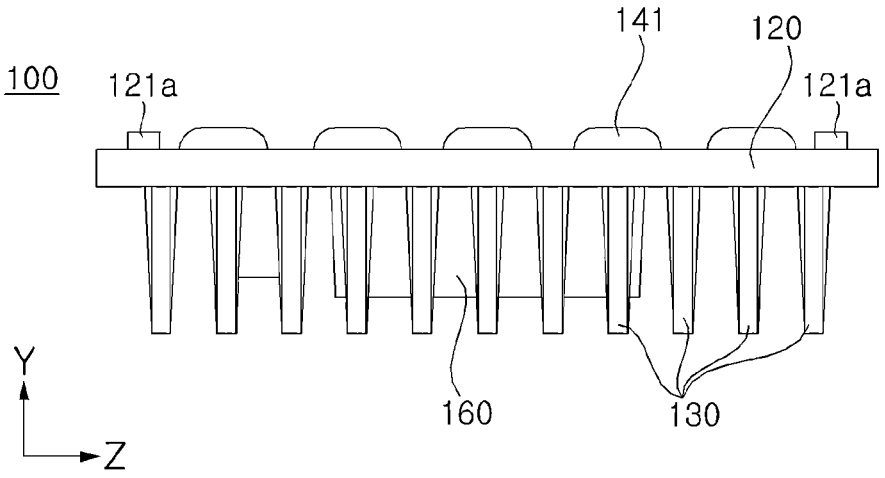
FIG. 3 is a front view of the light emitting module shown in FIG. 1.
Figure 4:
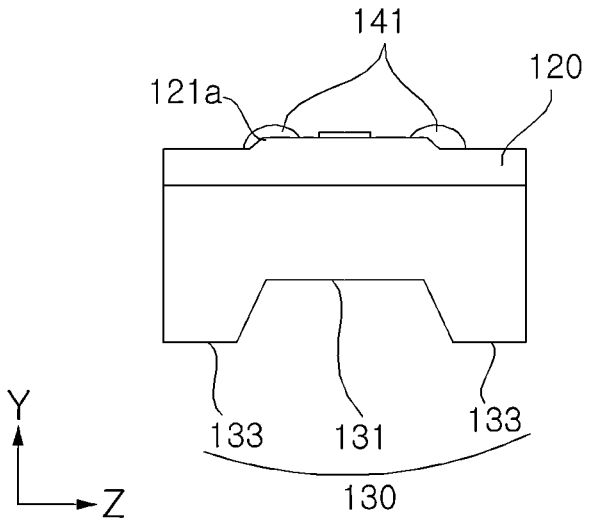
FIG. 4 is a side view of the light emitting module shown in FIG. 1.
Figure 5:
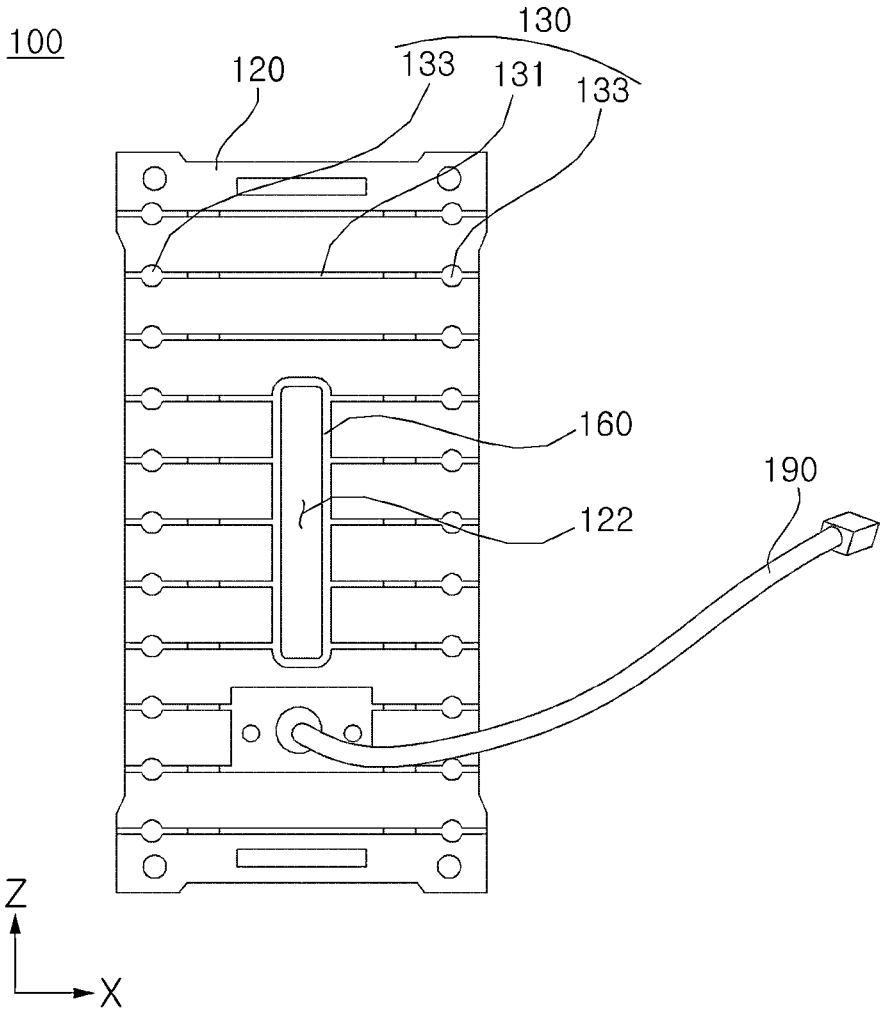
FIG. 5 is a rear view of the light emitting module shown in FIG. 1.

FIG. 1 is a perspective view showing a light emitting module according to an embodiment of the present invention, FIG. 2 is an exploded perspective view of the light emitting module shown in FIG. 1, FIG. 3 is a front view of the light emitting module shown in FIG. 1, FIG. 4 is a side view of the light emitting module shown in FIG. 1, and FIG. 5 is a rear view of the light emitting module shown in FIG. 1.

Referring to FIGS. 1 to 5, a light emitting module 100 according to an embodiment of the present invention includes a module body 120, a light source unit 110 disposed at one major surface of the module body 120, a plurality of heat dissipation fins 130 disposed at the other major surface of the module body 120 opposite to one major surface of the module body 120 at which the light source unit 110 is disposed, an air hole 122 formed through the module body 120 from one major surface of the module body 120 to the other major surface of the module body 120 for allowing air to flow therethrough, and an optical cover 140 for covering the light source unit 110, the optical cover 140 having a cover hole 143 corresponding to the air hole 122.

The light source unit 110 may include all means for generating light.

For example, the light source unit 110 may include a board 112 and a light emitting device 111 disposed on the board 112 in a state in which the light emitting device 111 is electrically connected to the board 112.

The board 112 is disposed at one major surface of the module body 120. One major surface of the module body 120 means the top surface of the module body 120 in FIG. 1. The board 112 is formed in a quadrangular shape corresponding to the shape of one major surface of the module body 120; however, the present invention is not limited thereto. For example, the board 112 may be formed in various shapes, such as a polygonal shape or an oval shape.

The board 112 may be an insulator having a circuit pattern printed thereon. For example, the board 112 may be a general printed circuit board (PCB), a metal core PCB, a flexible PCB, or a ceramic PCB.

On the other hand, the light source unit 110 may be a chips on board (COB) having a plurality of unpackaged LED chips directly bonded on a printed circuit board. The COB may contain a ceramic material to secure heat resistance and heat insulation.

The top surface of the board 112 may be coated with a material that is capable of efficiently reflecting light. For example, the top surface of the board 112 may be coated with a white or silver material.

One light emitting device 111 may be disposed on the board 112. Alternatively, a plurality of light emitting devices 111 may be disposed on the board 112. In a case in which a plurality of light emitting devices 111 is disposed on the board 112, the light emitting devices 111 may emit different colors or have different color temperatures.

Meanwhile, the light source unit 110 may be located in a light source location groove 121 formed at one major surface of the module body 120 such that the light source unit 110 is supported by the module body 120.

The light source location groove 121 is formed at one major surface of the module body 120 in a depressed shape and the board 112 is configured to have a shape corresponding to the shape of the light source location groove 121 such that the board 112 is located in the light source location groove 121.

Of course, as described below, a space, into which outer partition walls 145 and 146 of the optical cover 140 are inserted, may be defined between the light source location groove 121 and the edge of the board 112.

In this embodiment, the board 112 may be coupled to the module body 120 using a fastener f, such as a bolt. The module body 120 and the board 112 are provided with a fastening groove 114-1 and a fastening hole 114, respectively, such that the fastener is inserted into the fastening groove 114-1 via the fastening hole 114.

In addition, the board 112 is provided with an alignment hole 115, into which a protrusion of the optical cover 140 is inserted.

Specifically, the board 112 may be provided with a board hole 113 communicating with the air hole 122.

The board hole 113 is positioned above the air hole 122 such that the board hole 113 overlaps the air hole 122 vertically (in a Y-axis direction). The board hole 113 and the air hole 122 communicate with each other to provide an air flow space.

In the above description, the term "vertically" does not mean mathematically vertically, i.e. completely vertically, but means technologically vertically, i.e. vertically with tolerance.

Specifically, the board hole 113 has a shape and size corresponding to the shape and size of the air hole 122. The board hole 113 is formed at a middle portion of the board 112 in a lateral direction of the board 112 such that the board hole 113 extends in a longitudinal direction of the board 112.

The light emitting devices 111 may be arranged on the board 112 such that the light emitting devices 111 surround the board hole 113.

Specifically, the board hole 113 may be formed through the board 112 in the Y-axis direction and the light emitting devices 111 may be arranged on a plane defined by an X axis and a Z axis such that the light emitting devices 111 surround the board hole 113.

Between the board 112 and the light source location groove 121 may be disposed a heat dissipation pad 150 for improving heat transfer between the board 112 and the light source location groove 121.

The heat dissipation pad 150 may be formed in a shape corresponding to the shape of the light source location groove 121. In addition, the heat dissipation pad 150 may contain a material which exhibits high thermal conductivity and adhesiveness. For example, the heat dissipation pad 150 may be formed of a silicone material.

Specifically, the heat dissipation pad 150 may be formed in a film shape and may have a pad hole 153 communicating with the air hole 122.

The module body 120 provides a place at which the light source unit 110 is located and transfers heat generated from the light source unit 110 to the heat dissipation fins 130. In order to improve heat transfer efficiency, the module body 120 may be formed of a metal material or a resin material which exhibits a high heat dissipation rate; however, the present invention is not limited thereto.

For example, the module body 120 may be formed of at least one selected from among aluminum (Al), nickel (Ni), copper (Cu), silver (Ag), and tin (Sn). Alternatively, the module body 120 may be formed of at least one selected from among a resin material, such as polyphthalamide (PAA), silicon (Si), aluminum (Al), aluminum nitride (AlN), liquid crystal polymer, photo sensitive glass (PSG), polyamide 9T (PA9T), syndiotactic polystyrene (SPS), a metal material, sapphire ($Al_2O_3$), beryllium oxide (BeO), and ceramic.

The module body 120 may be formed by injection molding or etching; however, the present invention is not limited thereto.

The light source unit 110 is disposed at one major surface of the module body 120 and the heat dissipation fins 130 are coupled to the other major surface of the module body 120 opposite to one major surface of the module body 120 at which the light source unit 110 is disposed.

Specifically, a light source location groove 121, in which the light source unit 110 is located, may be formed at one major surface of the module body 120 and the heat dissipation fins 130 may be disposed at the other major surface of the module body 120 opposite to one major surface of the module body 120 at which the light source unit 110 is disposed.

The module body 120 may be formed in a plate shape. Specifically, the module body 120 may be formed in a quadrangular shape on the plane defined by the X axis and the Z axis.

The module body 120 may be provided at each corner thereof with a screw hole 126, through which a screw is inserted when the module body 120 is coupled to a light device, etc.

One major surface of the module body 120, to which the light source unit 110 and the optical cover 140 are coupled, will hereinafter be described.

Particularly, referring to FIG. 3, each of the heat dissipation fins 130 may have a shape configured to maximize the area of each of the heat dissipation fins 130 contacting air.

Specifically, each of the heat dissipation fins 130 may be formed in a plate shape extending downward (in a reverse Y-axis direction) from the other major surface (e.g. the bottom surface) of the module body 120.

More specifically, a large number of heat dissipation fins 130 may be arranged at regular pitches and each of the heat dissipation fins 130 may have a width equal to the width of the module body 120 such that heat generated from the module body 120 is effectively transferred to the heat dissipation fins 130.

The heat dissipation fins 130 may be integrally formed with the module body 120. Alternatively, the heat dissipation fins 130 may be formed separately from the module body 120.

Each of the heat dissipation fins 130 may contain a material, such as aluminum (Al), nickel (Ni), copper (Cu), silver (Ag), and tin (Sn), which exhibits a high heat transfer rate.

Referring to FIGS. 3 and 4, a large number of heat dissipation fins 130 may be mounted at the module body 120 at regular pitches in a longitudinal direction of the module body 120 (in the Z-axis direction). Each of the heat dissipation fins 130 may extend in a lateral direction of the module body 120 (in the X-axis direction).

Each of the heat dissipation fins 130 may be configured such that a middle part 131 of each of the heat dissipation fins 130 is more depressed toward the module body 120 than opposite ends 133 of each of the heat dissipation fins 130.

Each of the light emitting devices 111 is positioned above a corresponding one of the opposite ends 133 of a corresponding one of the heat dissipation fins 130 such that each of the light emitting devices 111 vertically overlaps a corresponding one of the opposite ends 133 of a corresponding one of the heat dissipation fins 130. As a result, the opposite ends 133 of each of the heat dissipation fins 130 are formed to have a larger height than the middle part 131 of each of the heat dissipation fins 130. Consequently, it is possible to enlarge the area of each of the heat dissipation fins 130 contacting air and to reduce manufacturing cost of each of the heat dissipation fins 130 based on the shape of the middle part 131 of each of the heat dissipation fins 130.

Referring back to FIGS. 1 and 2, the air hole 122 is formed through the module body 120 from one major surface of the module body 120 toward the heat dissipation fins 130 (in the Y-axis direction) to provide an air flow space.

The air hole 122 may be formed at a middle portion of the module body 120 such that the air hole 122 extends in the longitudinal direction of the module body 120.

The air hole 122 may be positioned above the board hole 113, which is formed at the board 112, the cover hole 143, which is formed at the optical cover 140, and the pad hole 153, which is formed at the heat dissipation pad 150, such that the air hole 122 vertically overlaps the board hole 113, the cover hole 143, and the pad hole 153. The air hole 122 may communicate with the board hole 113, the cover hole 143, and the pad hole 153.

The air hole 122 may circulate air based on a temperature difference between the inside and the outside of the air hole 122. The air circulated by the air hole 122 may accelerate cooling of the heat dissipation fins 130 and the module body 120.

Specifically, the air hole 122 may be positioned such that the air hole 122 vertically overlaps the middle part 131 of each of the heat dissipation fins 130 and the light emitting devices 111 may be positioned such that the light emitting devices 111 vertically overlap the opposite ends 133 of the heat dissipation fins 130.

More specifically, as shown in FIG. 2, the air hole 122 may be formed at the middle portion of the module body 120 such that the air hole 122 extends in a first direction (in the Z-axis direction) and the light emitting devices 111 may be arranged in a longitudinal direction of the air hole 122 such that the light emitting devices 111 are spaced apart from one another.

A majority or more of the light emitting devices 111 may be formed adjacent to sides of the air hole 122 extending in the longitudinal direction of the air hole 122. That is, a plurality of light emitting devices 111 may be arranged in two rows in the first direction and the air hole 122 may be formed between the rows of the light emitting devices 111 such that the air hole 122 extends in the first direction such that a majority or more of the light emitting devices 111 may be positioned adjacent to the sides of the air hole 122 extending in the longitudinal direction of the air hole 122. Consequently, it is possible to achieve effective heat transfer.

Of course, the board hole 113 may be formed in a shape corresponding to the shape of the air hole 122.

In addition, the area of the air hole 122 may be 10% to 20% the area of the module body 120 when viewed from above.

The air guide unit 160 may be formed at the edge of the air hole 122 in a state in which the air guide unit 160 extends outward (in the reverse Y-axis direction) from the other major surface of the module body 120 such that the air guide unit 160 communicates with the air hole 122 to guide air.

In particular, referring to FIG. 5, the air guide unit 160 may be formed in a cylindrical shape having a space defined therein. The air guide unit 160 may be positioned such that the edge of the air guide unit 160 overlaps the edge of the air hole 122. That is, the air guide unit 160 may be formed in a chimney shape surrounding the air hole 122.

The inner surface of the air guide unit 160 may be positioned on the same plane as the inner surface of the air hole 122 such that air flow between the air guide unit 160 and the air hole 122 is not disturbed.

The air guide unit 160 may be formed of a material which exhibits a high heat transfer rate. For example, the air guide unit 160 may be formed of at least one selected from among aluminum (Al), nickel (Ni), copper (Cu), silver (Ag), and tin (Sn). Alternatively, the air guide unit 160 may be formed of at least one selected from among a resin material, such as polyphthalamide (PAA), silicon (Si), aluminum (Al), aluminum nitride (AlN), liquid crystal polymer, photo sensitive glass (PSG), polyamide 9T (PA9T), syndiotactic polystyrene (SPS), a metal material, sapphire ($Al_2O_3$), beryllium oxide (BeO), and ceramic.

The air guide unit 160 may be thermally connected to at least some of the heat dissipation fins 130 such that heat transferred from the light emitting devices 111 to the heat dissipation fins 130 is transferred to the air guide unit 160.

Specifically, at least some of the heat dissipation fins 130 may be connected to the outer surface of the air guide unit 160.

The heat dissipation fins 130 are not positioned in the air guide unit 160 with the result that air flowing to the air guide unit 160 is not interfered with by the heat dissipation fins 130.

In addition, the module body 120 may be provided with a connector 190 for applying voltage to the light emitting devices 111 and a connector hole 124 formed through the connector 190.

The optical cover 140 covers the light source unit 110 to change properties of light generated by the light source unit 110 and to prevent introduction of external moisture into the light source unit 110.

In order to increase or decrease luminance and irradiation area of light, the surface of the optical cover 140 may be coated with a light diffusion paint (not shown), a light diffusion film (not shown) may be attached to the surface of the optical cover 140, or the optical cover 140 may be made of a transparent or semitransparent synthetic resin containing a light diffusion material.

A paint containing organic particle beads, such as polymethyl methacrylate (PMMA) or silicone, may be used as the light diffusion paint.

In this embodiment, the optical cover 140 is configured to have a structure in which the optical cover 140 is easily assembled to the module body 120 and isolates the light source unit 110 from the outside.

Hereinafter, the structure of one major surface of the module body, in which the optical cover 140 and the light source unit 110 are mounted, will be described in detail with reference to the accompanying drawings.

Figure 6A:
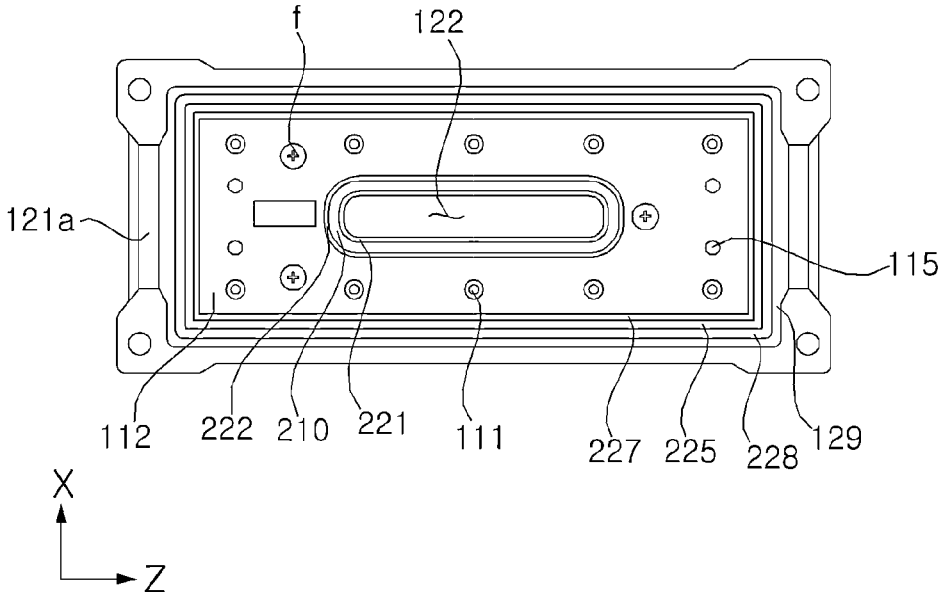
FIG. 6A is a plan view showing a state in which a light source unit according to an embodiment of the present invention is coupled to one major surface of a module body of the light emitting module.
Figure 6B:
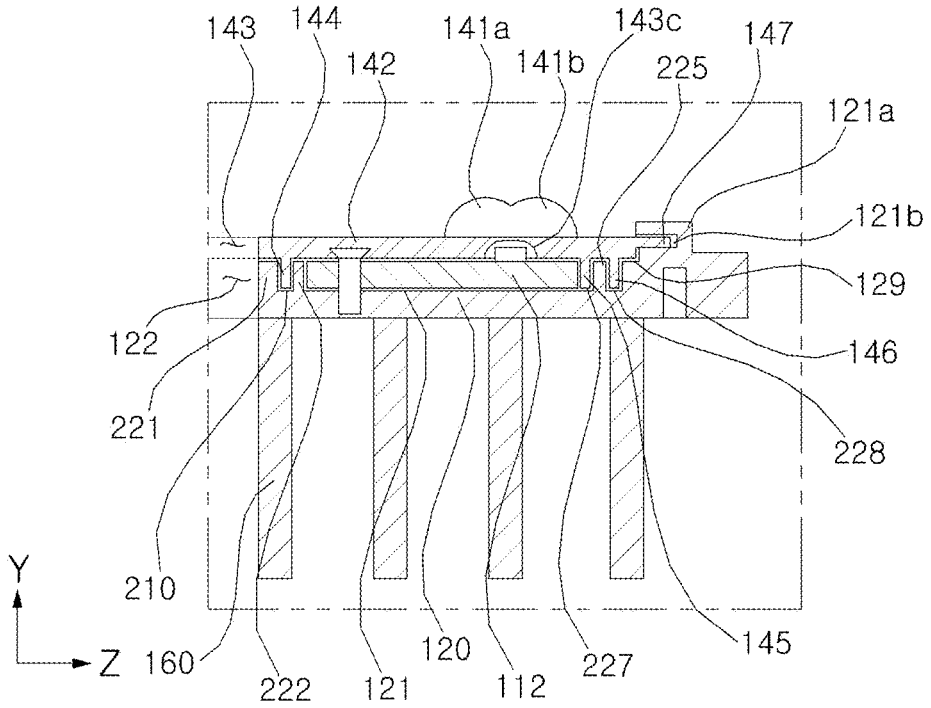
FIG. 6B is a sectional view taken along line A-A of FIG. 1.
Figure 7A:
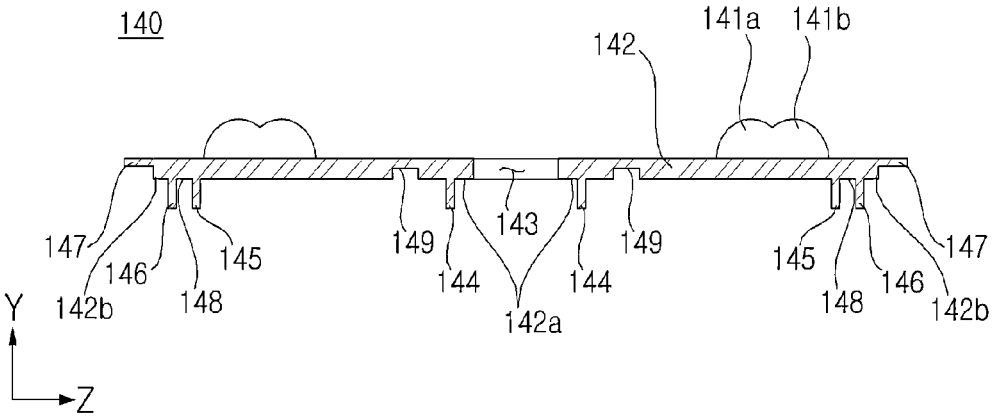
FIG. 7A is a sectional view showing an optical cover according to an embodiment of the present invention.
Figure 7B:
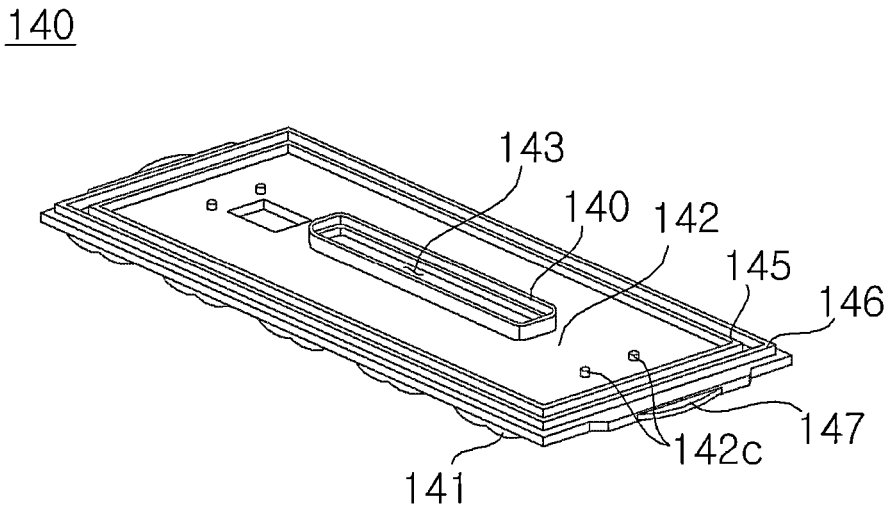
FIG. 7B is a perspective view of the optical cover according to the embodiment of the present invention when viewed from the rear.

FIG. 6A is a plan view showing a state in which a light source unit according to an embodiment of the present invention is coupled to one major surface of the module body of the light emitting module, FIG. 6B is a sectional view taken along line A-A of FIG. 1, FIG. 7A is a sectional view showing an optical cover according to an embodiment of the present invention, and FIG. 7B is a perspective view of the optical cover according to the embodiment of the present invention when viewed from the rear.

Before the detailed structure of the optical cover 140 is described, the structure of the module body 120, into which the optical cover 140 is inserted and coupled, will be described in detail.

Referring to FIGS. 6A and 6B, the optical cover 140, which covers the light source unit 110 in a sealed state, is inserted and coupled into one major surface of the module body 120.

For example, the module body 120 is provided at one major surface thereof with an inner coupling groove 210, which is formed along the circumference of the air hole 122.

The inner coupling groove 210 provides a space, into which an inner partition wall 144 of the optical cover 140, which will hereinafter be described, is inserted and coupled.

The inner coupling groove 210 is formed at one major surface of the module body 120 such that the inner coupling groove 210 extends along the circumference of the air hole 122 so as to surround the air hole 122 when viewed from above.

For example, the inner coupling groove 210 may be formed at one major surface (the top surface) of the module body 120 in a depressed shape. Of course, the shape and size of the inner coupling groove 210 correspond to the shape and size of the inner partition wall 144.

In another example, as shown in FIG. 6B, the light source location groove 121 may be formed at one major surface of the module body 120 in a depressed shape such that at least the board 112 of the light source unit 110 is located in the light source location groove 121. The inner coupling groove 210 may be defined by protrusions 221 and 222 protruding upward from the bottom surface of the light source location groove 121.

Specifically, the module body 120 may further include a first inner protrusion 221 and a second inner protrusion 222. The inner coupling groove 210 may be defined by the first inner protrusion 221 and the second inner protrusion 222.

The first inner protrusion 221 protrudes upward from one major surface of the module body 120. That is, the first inner protrusion 221 extends along the circumference of the air hole 122 such that the first inner protrusion 221 surrounds the air hole 122 when viewed from above.

In addition, in order to improve mobility of air, the inner side surface of the first inner protrusion 221 may be positioned on the same plane as the inner side surface of the air hole 122.

The first inner protrusion 221 is formed in a state in which the first inner protrusion 221 is more adjacent to the air hole 122 than the second inner protrusion 222.

The second inner protrusion 222 defines the inner coupling groove 210 together with the first inner protrusion 221. That is, the second inner protrusion 222 is formed at the outside of the first inner protrusion 221 such that the second inner protrusion 222 is spaced apart from the first inner protrusion 221 to surround the first inner protrusion 221.

The second inner protrusion 222 is fitted in the board hole 113 of the light source unit 110. Specifically, the board hole 113 is formed in a shape corresponding to the outer shape of the second inner protrusion 222 such that the second inner protrusion 222 is fitted in the board hole 113.

The thickness of the second inner protrusion 222 may correspond to the thickness of the board 112.

Meanwhile, one major surface of the module body 120 is configured to have the following structure.

The air hole 122 may be formed at one major surface of the module body 120 along a middle portion of the module body 120 such that the air hole 122 is formed through the module body 120. In addition, the first inner protrusion 221 and the second inner protrusion 222 defining the inner coupling groove 210 are formed at one major surface of the module body 120 such that the first inner protrusion 221 and the second inner protrusion 222 surround the air hole 122. The light source location groove 121, in which the board 112 of the light source unit 110 is located, is defined between the inner coupling groove 210, which is formed at one major surface of the module body 120, and the edge of the one major surface of the module body 120.

The light source location groove 121 has a size and shape corresponding to the size and shape of the board 112 such that the board 112 is positioned in the light source location groove 121.

Specifically, a region of one major surface of the module body 120 is depressed downward excluding the inner coupling groove 210 and the edge of one major surface of the module body 120 to form the light source location groove 121 when viewed from above.

Of course, the light source location groove 121 may have a size greater than the size of the board 112 to provide a space, into which outer partition walls 145 and 146, which will hereinafter be described, are inserted.

In addition, a cover location groove 129, in which the edge of the optical cover 140 is located, is formed at the circumference of the light source location groove 121 such that the cover location groove 129 extends along the circumference of the light source location groove 121.

Of course, the cover location groove 129 may be formed at one major surface of the module body 120 in a depressed shape such that the cover location groove 129 corresponds to the optical cover 140. Specifically, the cover location groove 129 has a sufficient size to receive at least a side surface (see FIG. 6B) and a bottom surface of the optical cover 140.

The bottom surface of the light source location groove 121 is positioned at a lower position than the bottom surface of the cover location groove 129 in consideration of the thickness of the board 112. The light source location groove 121 is received in the cover location groove 129.

In addition, the module body 120 is further provided at one major surface thereof with an outer protrusion 225, which is inserted into a cover groove 148 of the light source unit 110.

The outer partition walls 145 and 146 (specifically, a space 227 into which the first outer partition wall 145 is inserted) are defined between the outer protrusion 225 and the outer side surface (edge) of the board 112.

Specifically, the outer protrusion 225 is formed along the circumference of the board 112 such that the outer protrusion 225 surrounds the board 112 in a state in which the outer protrusion 225 is spaced apart from the board 112 when viewed from above.

The light source location groove 121 may be defined as a space between the outer protrusion 225 and the second inner protrusion 222.

In addition, the module body 120 may be further provided with an outer coupling groove 228 into which the second outer partition wall 146, which will hereinafter be described, is inserted.

The outer coupling groove 228 defines a space into which the second outer partition wall 146 is inserted. The outer coupling groove 228 surrounds the board 112.

Specifically, the outer coupling groove 228 is defined between the outer protrusion 225 and the cover location groove 129.

In particular, the cover location groove 129, which corresponds to the optical cover 140, is formed at one major surface of the module body 120 in a depressed shape, the light source location groove 121, which is depressed lower than the cover location groove 129, is formed in the cover location groove 129, and the bottom surfaces of the inner coupling groove 210 and the outer coupling groove 228 are formed at the same height as the bottom surface of the light source location groove 121 in consideration of the thicknesses of the optical cover 140 and the board 112.

The first inner protrusion 221, the second inner protrusion 222, and the outer protrusion 225 protrude upward from one major surface of the module body 120 (specifically, the bottom surface of the light source location groove 121) to define the inner coupling groove 210 and the outer coupling groove 228.

Of course, the upper ends of the first inner protrusion 221, the second inner protrusion 222, and the outer protrusion 225 may be positioned on the same plane as the bottom surface of the cover location groove 129.

In addition, an insertion groove 121*b*, into which a fitting wing 147 of the optical cover 140, which will hereinafter be described, is inserted, may be formed at the edge of the module body 120.

Of course, the optical cover 140 may be bonded to the module body 120 using an adhesive without the provision of the insertion groove 121*b*.

Specifically, a protruding end 121*a* protruding from each end of one major surface of the module body 120 is depressed inward to form the insertion groove 121*b*.

More specifically, the outer side surface of the cover location groove 129 is depressed outward to form the insertion groove 121*b*.

Hereinafter, the optical cover 140, which is inserted and coupled into one major surface of the module body 120, will be described in detail.

Referring to FIGS. 6B to 7B, for example, the optical cover 140 is formed in a plate shape to cover at least the optical unit 110.

In another example, the optical cover 140 may include a lens 141, configured to correspond to each light emitting device 111, for changing a beam angle of light generated by each light emitting device 111.

In a further example, the optical cover 140 may include an optical plate 142 and a lens 141 disposed on the optical plate 142.

The lens 141 diffuses light generated by each light emitting device 111. A diffusion angle of the light generated by each light emitting device 111 may be decided based on the shape of the lens 141.

For example, the lens 141 may cover each light emitting device 111 in a convex shape by molding.

Specifically, the lens 141 may contain a light transparent material.

For example, the lens 141 may be formed of transparent silicone, epoxy, or other resin materials.

In addition, a convex lens or a concave lens (not shown) may be used as the lens 141 so as to improve a light diffusion effect.

In order to improve a light diffusion effect, the lens 141 may be formed in a shape in which at least two oval spheres 141*a* and 141*b* overlap each other in a state in which the oval spheres 141*a* and 141*b* are inclined with respect to the optical plate 142 as shown in FIG. 6B.

The optical plate 142 covers at least the top surfaces of the board 112 and the light emitting devices 111. The optical plate 142 has a size greater than the size of the board 112.

The lens 141 is provided at the optical plate 142 on a position corresponding to each light emitting device 111.

The cover hole 143 may be formed at the optical plate 142 such that the cover hole 143 corresponds to the air hole 122.

Specifically, the cover hole 143 may be formed through a middle portion of the optical plate 142 vertically (in the Y-axis direction).

The optical cover 140 includes a partition wall protruding downward from the bottom of the optical cover 140 such that the partition wall is inserted into one major surface of the module body 120 to seal light source unit 100. The partition wall prevents introduction of external moisture or dust into the light source unit 110.

For example, the partition wall includes the inner partition wall 144 or the outer partition walls 145 and 146. In another example, the partition wall includes the inner partition wall 144 and the outer partition walls 145 and 146.

The inner partition wall 144 is inserted and coupled into one major surface of the module body 120 for preventing introduction of moisture into the light source unit 110 from the air hole 122.

The inner partition wall 144 is inserted into one major surface of the module body 120 defining the circumference of the air hole 122.

The inner partition wall 144 may be coupled into one major surface of the module body 120 by forced fitting. In particular, the inner partition wall 144 is tightly coupled into the inner coupling groove 210 so as to prevent introduction of external moisture and foreign matter. An adhesive may be applied to the inner coupling groove 210.

Specifically, the inner partition wall 144 is formed at the optical plate 142 such that the inner partition wall 144 extends downward along the circumference of the cover hole 143 corresponding to the air hole 122.

More specifically, a space 142*a*, in which the first inner protrusion 221 is supported, is defined between the inner partition wall 144 and the cover hole 143 of the optical plate 142.

In this embodiment, the optical cover 140 further includes the outer partition walls 145 and 146.

Of course, according to embodiments, the optical cover 140 may include only the outer partition walls 145 and 146, may include only the inner partition wall 144, or may include the outer partition walls 145 and 146 and the inner partition wall 144; however, the present invention is not limited thereto.

The outer partition walls 145 and 146 are inserted and coupled into one major surface of the module body 120 for preventing introduction of moisture into the light source unit 110 from the edge of the module body 120.

The outer partition walls 145 and 146 are inserted into the edge of the one major surface of the module body 120 such that the outer partition walls 145 and 146 surround at least the light source unit 110.

The outer partition walls 145 and 146 may be coupled into one major surface of the module body 120 by forced fitting.

In particular, the outer partition walls 145 and 146 are tightly coupled into the outer coupling groove 228 so as to prevent introduction of external moisture and foreign matter. An adhesive may be applied to the outer coupling groove 228.

Specifically, the outer partition walls 145 and 146 are formed at the edge of the optical cover 140 such that the outer partition walls 145 and 146 extend downward along the circumference of the optical cover 140. The outer partition walls 145 and 146 define a closed space, in which at least the light source unit 110 is positioned, when viewed from above.

More specifically, the outer partition walls 145 and 146 are disposed so as to surround the outer surface of the board 112. The outer surface of the board 112 means a surface of the board 112 spaced apart from the air hole 122 when viewed from above.

In addition, the outer partition walls 145 and 146 may be fitted into the light source location groove 121 together with the board 112. Specifically, as shown in FIG. 6B, the first outer partition wall 145 may be fitted into the light source location groove 121 together with the board 112.

In another example, the outer partition walls 145 and 146 (specifically, the first outer partition wall 145) may be inserted into a space defined between the outer protrusion 225 and the outer side surface (edge) of the board 112.

For example, the outer partition walls 145 and 146 includes the first outer partition wall 145 and the second outer partition wall 146.

The first outer partition wall 145 is disposed in contact with the outer surface of the board 112 such that the first outer partition wall 145 surrounds the board 112.

The second outer partition wall 146 is disposed in a state in which the second outer partition wall 146 is spaced apart from the first outer partition wall 145 such that the second outer partition wall 146 surrounds the first outer partition wall 145. The second outer partition wall 146 defines the cover groove 148 together with the first outer partition wall 145.

The outer protrusion 225 is inserted and coupled into the cover groove 148.

More specifically, the outer partition walls 145 and 146 are spaced apart inward from the edge of the optical plate 142. That is, the outer partition walls 145 and 146 define a space 142*b* located in the cover location groove 129 at the edge of the optical plate 142.

The optical cover 140 is provided with an alignment protrusion 142*c* protruding from the optical plate 142 such that the alignment protrusion 142*c* is inserted into the alignment hole 115.

Unexplained reference numeral 149 indicates a head groove, in which a head of the fastener f is positioned.

The outer coupling groove 228 may be positioned such that the outer coupling groove 228 is spaced apart inward from the edge of the cover location groove 129.

The optical cover 140 further includes the fitting wing 147, which is inserted into the module body 120.

The fitting wing 147 is inserted into the module body 120 in a direction in which the fitting wing 147 intersects the partition wall for preventing separation of the partition wall. For example, the fitting wing 147 may protrude from each side of the optical cover 40 outward (in the Z-axis direction). That is, a pair of fitting wings 147 is provided at opposite sides of the optical cover 140.

The fitting wings 147 restrain vertical movement of the optical cover 140, which is inserted downward. In a case in which an adhesive is applied to the partition wall of the optical cover 140 or to the cover location groove 129 of the module body 120, the fitting wings 147 push the optical cover 140 downward while the adhesive is hardened.

Specifically, the fitting wings 147 may protrude from opposite ends of the optical plate 142 in the longitudinal direction or in the lateral direction.

More specifically, each of the fitting wings 147 is formed in a shape corresponding to the shape of a corresponding one of the insertion grooves 121*b* formed at the module body 120 such that the fitting wings 147 are inserted and coupled into the respective insertion grooves 121*b*.

In addition, the optical cover 140 may be pushed downward due to elastic restoring force of the fitting wings 147. To this end, each of the fitting wings 147 may have a sufficient thickness for each of the fitting wings 147 to have elastic force.

For example, each of the fitting wings 147 is formed of the same transparent resin material as the optical plate 142 of the optical cover 140. In addition, each of the fitting wings 147 has a smaller thickness than the optical plate 142. If the thickness of each of the fitting wings 147 is less than that of the optical plate 142, it is possible to form a space, into which each of the fitting wings 147 is inserted, at the module body 120 without increasing the thickness of the module body 120.

More specifically, as shown in FIG. 6B, the top surface of each of the fitting wings 147 may be positioned at the same plane as the top surface of the optical plate 142 and the bottom surface of each of the fitting wings 147 may be positioned higher than the bottom surface of the optical plate 142.

The fitting wings 147 are inserted into one major surface of the module body 120 in the left and right directions such that the fitting wings 147 are coupled into the module body 120. Specifically, the fitting wings 147 are inserted into the module body 120 surrounding at least two opposite sides of the optical plate 142 in the left and right directions.

For example, the upwardly protruding ends 121*a* protrude from opposite ends of one major surface of the module body 120 surrounding the optical plate 142 and the inner side surfaces of the protruding ends 121*a* are depressed outward to form the insertion grooves 121*b*, into which the respective fitting wings 147 are inserted. The inner side surfaces of the protruding ends 121*a* are positioned more adjacent to the middle of the module body 120 than the outer side surfaces of the protruding ends 121*a*. That is, the insertion grooves 121*b* are formed as the result of the inner side surfaces of the protruding ends 121*a* being depressed outward.

Of course, the outer side surface of the cover location groove 129 may be depressed to form the insertion grooves 121*b*, which will hereinafter be described.

Figure 8:
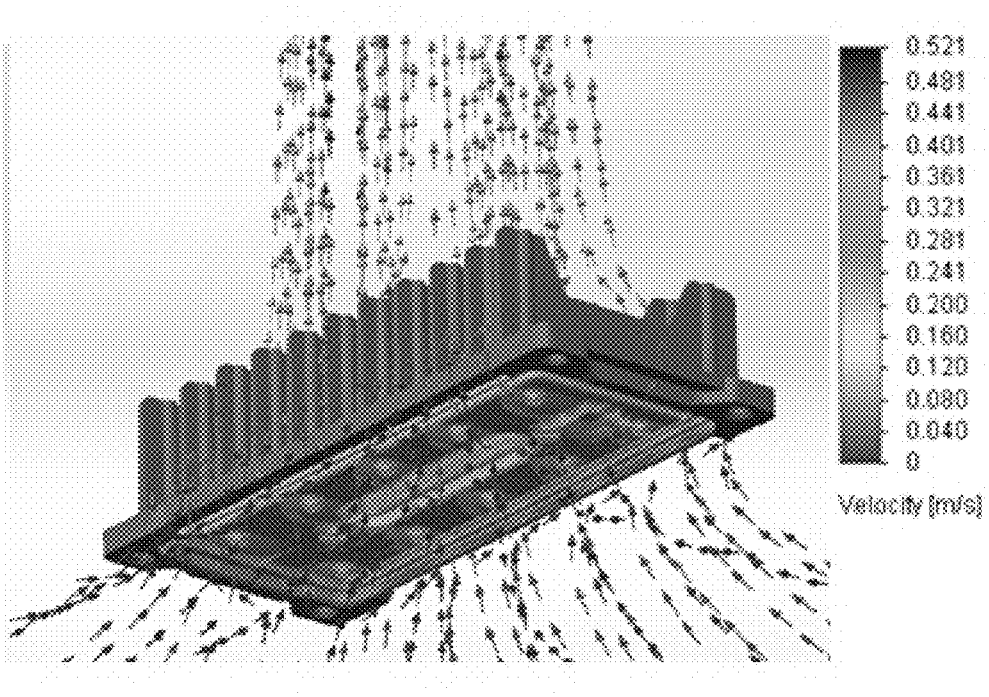
FIG. 8 is a view showing air flow distribution of the light emitting module according to the embodiment of the present invention.

FIG. 8 is a view showing air flow distribution of the light emitting module 100 according to the embodiment of the present invention.

Hereinafter, air flow and heat dissipation of the light emitting module 100 will be described with reference to FIG. 8.

Generally, the light emitting module 100 is installed such that the light emitting devices 111 face in a direction of gravity so as to illuminate an object on the ground.

When voltage is applied to the light emitting devices 111, light is generated by the light emitting devices 111 with the result that heat is generated from the light emitting devices 111.

The heat generated from the light emitting devices 111 is transferred to the board 112 and the heat dissipation pad 150 and then diffused to the module body 120, the air guide unit 160, and the heat dissipation fins 130.

In particular, most of the heat generated from the light emitting devices 111 is transferred to the module body 120, which exhibits a high transfer rate, the heat dissipation fins 130, and the air guide unit 160.

As a result, a temperature difference is generated between the outside and the inside of the light emitting module 100.

In particular, the internal temperature of the air guide unit 160 and the internal temperature of the air hole 122 are higher than the external temperature of the light emitting module 100.

Consequently, air in the air guide unit 160 and the air hole 122 moves upward due to buoyancy and then cool air from below the light emitting devices 111 is introduced into the light emitting module 100 (a chimney effect).

Such circulation of the air may maximize a heat dissipation effect of the light emitting devices 111 based on external air.

In particular, as shown in FIG. 8, velocity of air having passed through the air hole 122 and the air guide unit 160 is higher than velocity of air in the other parts.

In this embodiment, therefore, it is possible to cool the light emitting module 100 without using an additional fan.

Figure 9:
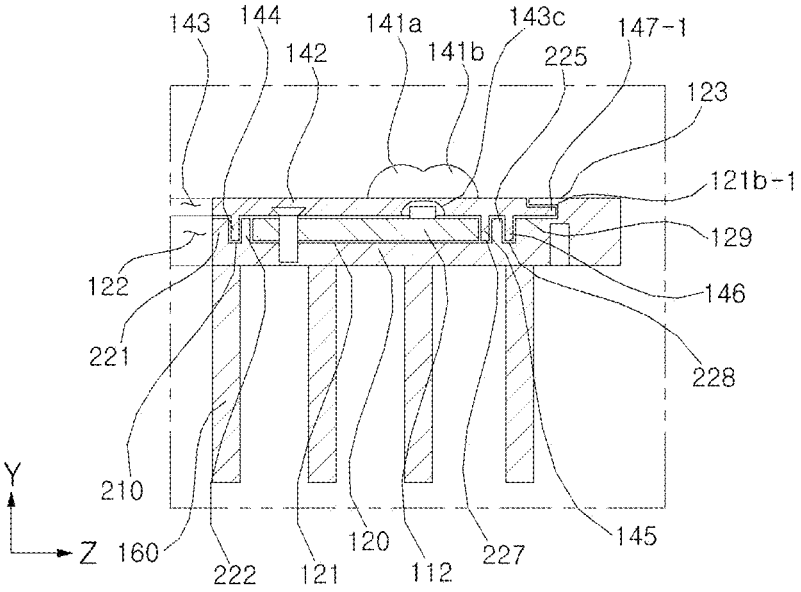
FIG. 9 is a sectional view showing a light emitting module according to another embodiment of the present invention.

FIG. 9 is a sectional view showing a light emitting module according to another embodiment of the present invention.

The light emitting module according to the embodiment shown in FIG. 9 is different from the light emitting module according to the embodiment shown in FIG. 6B in that positions of a fitting wing 147-1 and an insertion groove **121*b*-1** are changed.

In this embodiment, a top surface of the fitting wing 147-1 has a step positioned lower than a top surface of an optical plate 142. That is, a space, in which a portion of a module body 120 is positioned, is defined at the top of the fitting wing 147-1.

In this embodiment, the module body 120 has no protruding end unlike the embodiment shown in FIG. 6.

A side surface of a cover location groove 129 is depressed to form the insertion groove **121*b*-1. Specifically, an inner side surface of the cover location groove 129 is depressed outward to form the insertion groove 121*b*-1. A pair of insertion grooves 121*b*-1 is formed at the inner side surfaces of the cover location grooves 129** which are opposite to each other.

In a case in which the inner side surfaces of the cover location grooves 129 are depressed to form the insertion grooves **121*b*-1, it is not necessary for an edge 123 of the module body 120 to protrude. At this time, the top surface of the optical plate 142 of the optical cover 140 is positioned at the same plane as the top surface of the edge 123 of the module body 120** for aesthetically pleasing appearance.

Figure 10:
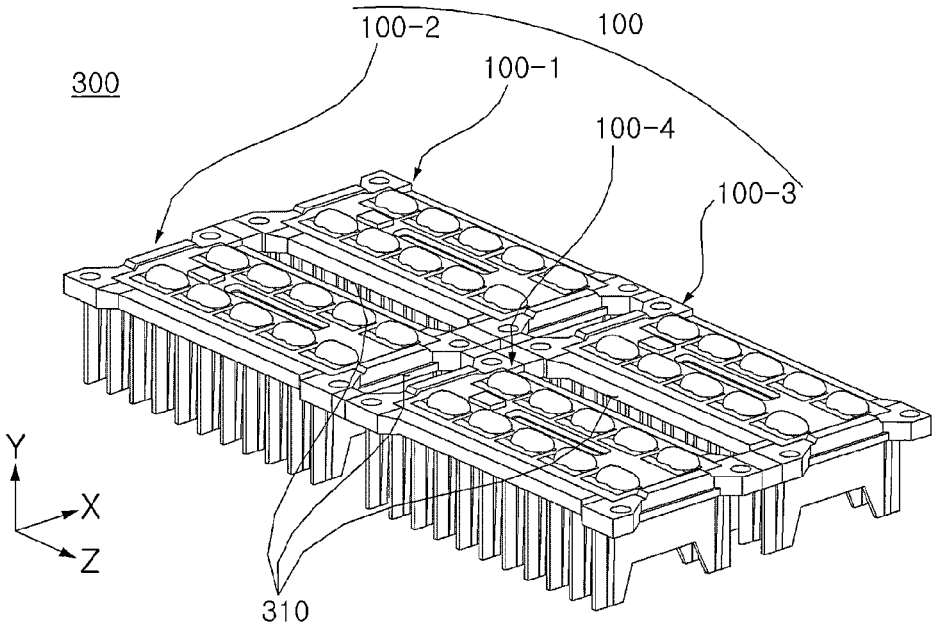
FIG. 10 is a perspective view showing a module array including light emitting modules according to an embodiment of the present invention.
Figure 11:
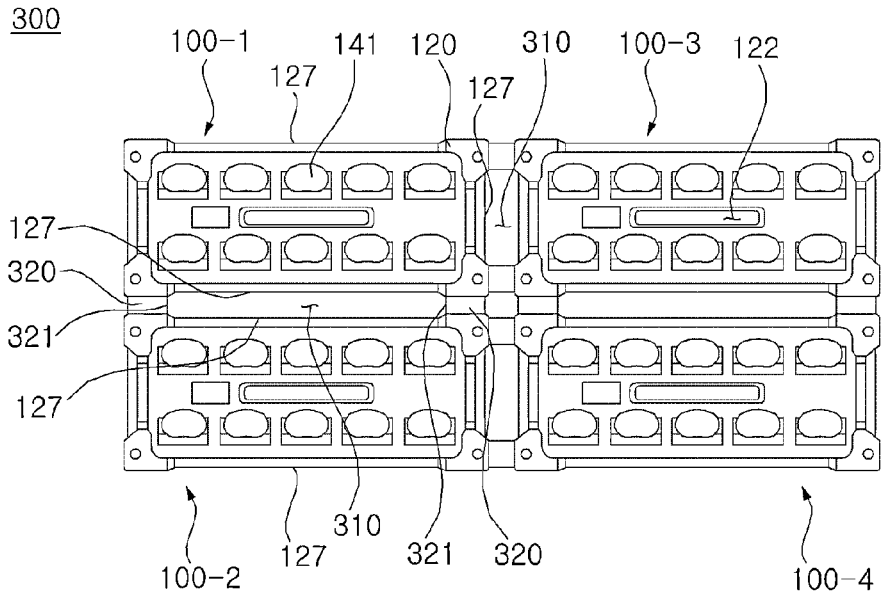
FIG. 11 is a plan view of the module array shown in FIG. 10.

FIG. 10 is a perspective view showing a module array including light emitting modules according to an embodiment of the present invention and FIG. 11 is a plan view of the module array shown in FIG. 10.

A module array 300 according to an embodiment of the present invention includes at least two light emitting modules 100, which are coupled to each other.

Referring to FIGS. 10 and 11, a plurality of light emitting modules 100 may be coupled to each other so as to constitute the module array 300 according to the embodiment of the present invention as described above.

Specifically, the module array 300 may be configured such that a plurality of light emitting modules 100 is arranged in a direction parallel to one major surface of the module body 120 of each of the light emitting modules 100 (in a planar direction defined by an X axis and a Z axis; hereinafter, referred to as a horizontal direction).

More specifically, the module array 300 may be configured such that the light emitting modules 100 are arranged at regular pitches. In addition, as shown in FIG. 11, the module array 300 may be configured such that the light emitting modules 100 are arranged in a lateral direction and/or a longitudinal direction of each of the light emitting modules 100.

Air flow holes 310, through which air flows, are formed between the respective light emitting modules 100 of the module array 300 such that the air flow holes 310 are formed through the module array 300 from one major surface to the other major surface of the module array 300 (in a Y-axis direction; hereinafter, referred to as a vertical direction).

The air flow holes 310 are positioned between the respective light emitting modules 100 for accelerating circulation of air due to a temperature difference between the inside and the outside of each of the air flow holes 310.

Air in the air flow holes 310 are heated by heat transferred from the light emitting devices 111 via the main bodies 120. The heated air rises upward due to buoyancy with the result that air flows upward from below the air flow holes 310 (a so-called chimney effect).

The air flow holes 310 are positioned between the respective light emitting modules 100 as described above and, therefore, it is possible to effectively remove heat generated from the light emitting modules 100, thereby effectively cooling the light emitting modules 100.

For example, one air flow hole 310 may be formed between two adjacent light emitting modules 100.

Specifically, one air flow hole 310 may be positioned between a module body 120 of a first light emitting module 100-1 and a module body 120 of a second light emitting module 100-2 adjacent to the first light emitting module 100-1.

More specifically, a side surface 127 of each of the main bodies 120 of the two adjacent light emitting modules 100 may define a portion of the inner circumference of the air flow hole 310. The side surface 127 of each of the main bodies 120 is a surface perpendicular to one major surface and the other major surface of the each of the main bodies 120. That is, the side surface 127 of each of the main bodies 120 is a surface defining a lateral outer surface of each of the main bodies 120.

Of course, the air flow hole 310 may be positioned between the first light emitting module 100-1 and the second light emitting module 100-2 arranged adjacent to the first light emitting module 100-1 in a lateral direction of the first light emitting module 100-1 or between the first light emitting module 100-1 and a third light emitting module 100-3 arranged adjacent to the first light emitting module 100-1 in a longitudinal direction of the first light emitting module 100-1.

The module array 300 may further include connection members 320 connected between the respective adjacent light emitting modules 100.

The connection members 320 may be connected between the module bodies 120 of the respective adjacent light emitting modules 100.

Two connection members 320 may be disposed such that the connection members 320 are spaced apart from each other.

The connection members 320 define the edge of the air flow hole 310. For this reason, each of the connection members 320 may be made of a material which exhibits a high heat transfer rate.

For example, each of the connection members 320 may be made at least one selected from among aluminum (Al), nickel (Ni), copper (Cu), silver (Ag), and tin (Sn).

Specifically, referring to FIG. 11, side surfaces 321 of two connection members 320 which are spaced apart from each other and side surfaces 127 of main bodies 120 of two light emitting modules 100 which are adjacent to each other may define an inner circumference of one air flow hole 310. The side surface 321 of each of the connection members 320 means a surface perpendicular to the planar direction defined by the X axis and the Z axis.

For example, the air flow hole 310 may be formed in any one selected from among a quadrangular shape, a polygonal shape, and a circular shape in section.

Particularly, in a case in which the air flow hole 310 is formed in a quadrangular shape in section, the side surface 127 of the module body 120 of the first light emitting module 100-1 and the side surface 127 of the module body 120 of the second light emitting module 100-2 adjacent to the first light emitting module 100-1 define opposite sides of the quadrangular shape and the side surfaces 321 of the connection members 320 connected between the first light emitting module 100-1 and the second light emitting module 100-2 define the other opposite sides of the quadrangular shape.

In other words, a plurality of light emitting modules 100 is arranged such that the light emitting modules 100 are spaced apart from each other in the horizontal direction and a plurality of connection members 320 is connected between the light emitting modules 100. The side surfaces 321 of the connection members 320 and the side surfaces 127 of the module bodies 120 of the adjacent light emitting modules define air flow holes 310, which are vertically formed through the module array 300.

In addition, the connection members 320 may be positioned adjacent to corner portions of the side surfaces 127 of the module bodies 120. As shown in FIG. 11, the connection members 320 may be positioned adjacent to corner portions of the side surfaces 127 of the module bodies 120 to increase the size of each of the air flow holes 310 and to further accelerate circulation of air between the inside and the outside of each of the air flow holes 310.

The connection members 320 may be integrally formed with the module bodies 120. Alternatively, the connection members 320 may be formed separately from the module bodies 120.

Figure 12:
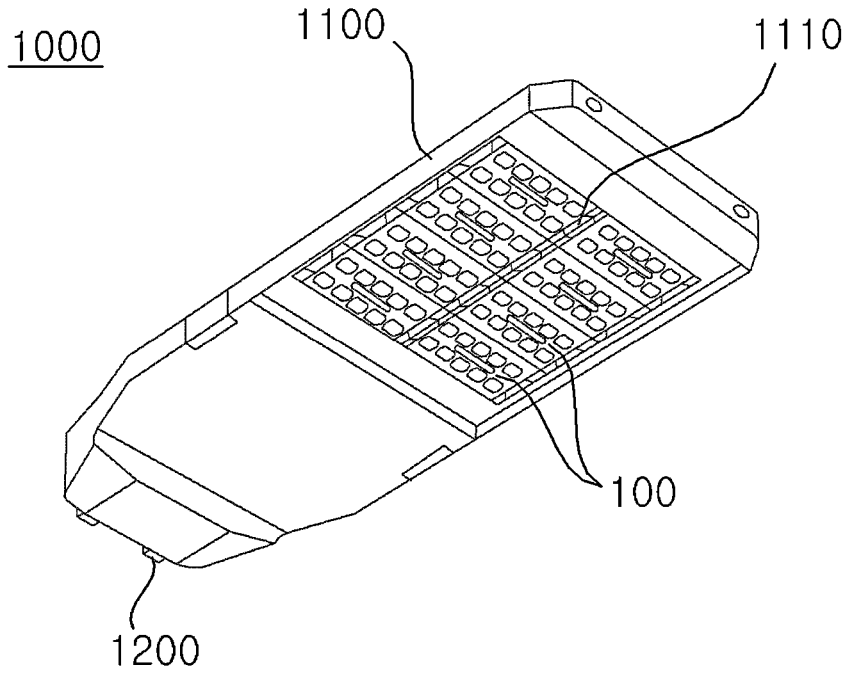
FIG. 12 is a perspective view showing a lighting device including light emitting modules according to an embodiment of the present invention.

FIG. 12 is a perspective view showing a lighting device including light emitting modules according to an embodiment of the present invention.

Referring to FIG. 12, a lighting device 1000 according to an embodiment of the present invention may include a device body 1100 providing a space in which light emitting modules 100 are coupled to the lighting device 1000, the device body 1100 forming the external appearance of the lighting device 1000 and a connection unit 1200 having a power supply unit (not shown) coupled to one side of the device body 1100 for supplying power to the device body 1100 mounted therein, the connection unit 1200 being connected between the device body 1100 and a support unit (not shown).

The lighting device 1000 according to the embodiment of the present invention may be installed indoors or outdoors. For example, the lighting device 1000 according to the embodiment of the present invention may be used as a streetlight.

The device body 1100 may include a plurality of frames 1110 providing a space in which at least two light emitting modules 100 are positioned.

The power supply unit is mounted in the connection unit 1200. The connection unit 1200 is connected between the device body 1100 and the support unit, through which the device body 1100 is fixed to the outside.

In a case in which the lighting device 1000 according to the embodiment of the present invention is used, it is possible to effectively remove heat generated from the light emitting modules 100 due to a chimney effect, thereby effectively cooling the light emitting modules 100. In addition, it is possible to cool the light emitting modules 100 without using an additional fan, thereby reducing manufacturing cost of the lighting device 1000.

As is apparent from the above description, in the light emitting module according to the embodiment of the present invention, the internal temperature of the air guide unit and the internal temperature of the air hole are higher than the external temperature of the light emitting module. As a result, air in the air guide unit and the air hole moves upward due to buoyancy and then cool air from below the light emitting devices is introduced into the light emitting module (a chimney effect). Consequently, it is possible to effectively dissipate heat generated from the light emitting module.

In addition, velocity of air having passed through the air hole and the air guide unit is higher than convection based on general heat. Consequently, it is possible to improve a heat dissipation effect.

In addition, it is possible to cool the light emitting module without using an additional fan.

In a case in which the lighting device according to the embodiment of the present invention is used, on the other hand, it is possible to effectively remove heat generated from the light emitting modules due to the chimney effect, thereby effectively cooling the light emitting modules. In addition, it is possible to cool the light emitting modules without using an additional fan, thereby reducing manufacturing cost of the lighting device.

In addition, the optical cover is fitted in the circumference of the air hole, whereby it is possible to prevent introduction of external moisture and foreign matter from the air hole.

In addition, the inner coupling groove, formed at the circumference of the air hole for preventing introduction of moisture from the air hole, is positioned on the same plane as the inner surface of the air hole. Consequently, it is possible to reduce interference with air flowing through the air hole.

In addition, the outer partition walls are formed so as to surround the light source unit, whereby it is possible for the optical cover to effectively reduce introduction of moisture and foreign matter into the light source unit.

In addition, a portion of each of the outer partition walls and the edge of the board are fitted in the light source location groove, whereby it is possible to effectively fix the light source unit and to improve waterproof performance.

In addition, the fitting wings are inserted into the optical cover in the direction in which the fitting wings intersects the partition wall, whereby it is possible to prevent separation of the optical cover and to push the optical cover while an adhesive is hardened.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A light emitting module comprising:

a module body having a first side and a second side opposite to the first side;

a light source unit located at the first side of the module body;

an air hole formed through the module body from the first side of the module body to the second side of the module body for allowing air to flow therethrough;

an optical cover covering the light source unit, the optical cover having a cover hole at a location corresponding to the air hole, wherein the optical cover comprises:

a partition wall protruding from a first side of the optical cover, the partition wall extending into the first side of the module body to seal the light source unit; and a pair of fitting wings protruding outward from opposite ends of the optical cover, the fitting wings being inserted into the module body; and an air guide unit located at an edge of the air hole, wherein the air guide unit extends in a direction away from the second side of the module body, the air guide unit being in communication with the air hole to guide the flow of air therethrough, wherein the air guide unit is located outside the module body, and wherein the air guide unit forms a closed space.

2. The light emitting module according to claim 1, wherein the optical cover is biased toward the first side of the module body due to an elastic restoring force of the fitting wings.

3. The light emitting module according to claim 1, wherein the module body comprises insertion grooves into which the respective fitting wings are inserted.

4. The light emitting module according to claim 3, wherein the module body further comprises protruding ends protruding upward from opposite ends of the first side of the module body, and wherein inner side surfaces of the protruding ends are depressed to form the insertion grooves.

5. The light emitting module according to claim 3, wherein the module body further comprises a cover location groove for receiving at least the bottom surface and a portion of a side surface of the optical cover, and wherein an Inner side surface of the cover location groove is depressed to form the insertion grooves.

6. The light emitting module according to claim 5, wherein the insertion grooves are located at opposite portions of the inner side surface of the cover location groove.

7. The light emitting module according to claim 5, wherein the optical cover comprises:

a lens for changing a beam angle of light; and an optical plate at which the lens is disposed, wherein a top surface of an edge of the module body and a top surface of the optical plate are positioned on a same plane.

8. The light emitting module according to claim 7, wherein the fitting wings are positioned at opposite ends of the optical plate in a longitudinal direction of the optical plate, and wherein each of the fitting wings has a smaller thickness than a thickness of the optical plate.

9. The light emitting module according to claim 1, wherein a height of the air guide unit is higher than a height of the module body.

10. The light emitting module according to claim 9, wherein the partition wall comprises an inner partition wall located around a periphery of the cover hole, the inner partition wall extending into the first side of the module body around a periphery of the air hole.

11. The light emitting module according to claim 10, wherein the first side of the module body includes an inner coupling groove at a location corresponding to the inner partition wall, the inner partition wall being inserted into the inner coupling groove.

12. The light emitting module according to claim 11, wherein the module body comprises:

a first inner protrusion protruding away from the first side of the module body; and a second inner protrusion protruding away from the first side of the module body and defining the inner coupling groove together with the first inner protrusion.

13. The light emitting module according to claim 12, wherein the first inner protrusion is closer to the air hole than the second inner protrusion, and wherein an inner side surface of the first inner protrusion is on a same plane as an inner side surface of the air hole.

14. The light emitting module according to claim 13, wherein the light source unit comprises:

a board located at the first side of the module body, the board having a board hole at a location corresponding to the air hole; and a plurality of light emitting devices located on the board, wherein the Second inner protrusion extends into the board hole.

15. The light emitting module according to claim 14, wherein the partition wall further includes an outer partition wall located at a periphery of the optical cover, the outer partition wall. extending away from a main body portion of the optical cover, and wherein the outer partition wall defines a closed space in which the light source unit is located, the outer partition wall extending into the first side of the module body.

16. The light emitting module according to claim 15, wherein the first side of the module body includes a light source location groove, the board being located in the light source location groove, and wherein the outer partition wall is fitted in the light source location groove together with the board.

17. The light emitting module according to claim 15, wherein the outer partition wall comprises:

a first outer partition wall located at an outer surface of the board;

a second outer partition wall spaced apart from the first outer partition wall such that the second outer partition wall surrounds the first outer partition wall; and a cover groove defined between the first outer partition wall and the second outer partition wall.

18. The light emitting module according to claim 17, wherein the first side of the module body includes an outer protrusion at a location corresponding to the cover groove, the outer protrusion extending into the cover groove, and wherein a space is defined between the outer protrusion and an outer side surface of the board into which the first outer partition wall extends.

19. The light emitting module according to claim 9, wherein the partition wall further includes an outer partition wall located at a periphery of the optical cover, the outer partition wall extending away from a main body portion of the optical cover, and wherein the outer partition wall defines a closed space in which the light source unit is located, the outer partition wall extending into the first side of the module body.

20. The light emitting module according to claim 9, further comprising a plurality of heat dissipation fins located at the second side of the module body, wherein the air guide unit is thermally connected to at least two of the heat dissipation tins.

* * * * *